US011835325B2

(12) United States Patent
Carr et al.

(10) Patent No.: US 11,835,325 B2
(45) Date of Patent: Dec. 5, 2023

(54) ANTI-AIR SHELL FOR TELESCOPED AMMUNITION WITH DOUBLE UNLOCK

(71) Applicant: CTA INTERNATIONAL, Versailles (FR)

(72) Inventors: Chris Carr, Bourges (FR); Titouan Voillot, Bourges (FR)

(73) Assignee: CTA INTERNATIONAL, Versailles (FR)

( * ) Notice: Subject to any disclaimer, the term of this patent is extended or adjusted under 35 U.S.C. 154(b) by 0 days.

(21) Appl. No.: 17/636,112

(22) PCT Filed: Oct. 5, 2020

(86) PCT No.: PCT/EP2020/077869

§ 371 (c)(1),
(2) Date: Feb. 17, 2022

(87) PCT Pub. No.: WO2021/044065

PCT Pub. Date: Mar. 11, 2021

(65) Prior Publication Data

US 2022/0373312 A1 Nov. 24, 2022

(30) Foreign Application Priority Data

Sep. 6, 2019 (FR) ..... 1909820

(51) Int. Cl.
*F42B 12/62* (2006.01)

(52) U.S. Cl.
CPC ..... *F42B 12/62* (2013.01)

(58) Field of Classification Search
CPC ..... F42B 12/56; F42B 12/58; F42B 12/60; F42B 12/62; F42B 12/64
See application file for complete search history.

(56) References Cited

U.S. PATENT DOCUMENTS

| | | | | |
|---|---|---|---|---|
| 34,602 A * | 3/1862 | Townsend | F42B 12/60 102/497 |
| 94,647 A * | 9/1869 | Richards | F42B 12/60 102/497 |
| 785,285 A * | 3/1905 | Wratzke | F42B 12/60 102/497 |

(Continued)

FOREIGN PATENT DOCUMENTS

| | | |
|---|---|---|
| EP | 0 698 774 A1 | 2/1996 |
| FR | 2 998 659 A1 | 5/2014 |
| GB | 2 517 447 A | 2/2015 |

OTHER PUBLICATIONS

Dec. 16, 2020 Search Report issued in International Patent Application No. PCT/EP2020/077869.

*Primary Examiner* — Derrick R Morgan

(74) *Attorney, Agent, or Firm* — Oliff PLC

(57) ABSTRACT

A medium calibre gyro-stabilized anti-air shell intended to produce a spray of sub-projectiles, wherein it includes an ogive shaped nose cone extended by a case tube and a central pin delimiting with the case tube a housing enclosing sub-projectiles, a casing covering the case tube attached, by an upstream thread at its front end, to a flange on the nose cone and attached by a downstream thread at its rear end onto a rear end cap enclosing an air burst charge, translation means being positioned between the rear end cap and the case tube so as to ensure the shearing of the upstream and downstream threads.

10 Claims, 1 Drawing Sheet

(56) References Cited

U.S. PATENT DOCUMENTS 840,984 A * 1/1907 Ziegenfuss ..... F42B 12/60 102/497
982,338 A * 1/1911 Wratzke ..... F42B 12/60 102/497
1,039,850 A * 10/1912 Völler ..... F42B 12/60 102/497
1,098,202 A * 5/1914 Wieser ..... F42B 12/60 102/497
1,305,967 A * 6/1919 Hawks ..... F42B 12/32 102/494
1,315,113 A * 9/1919 Gilmartin ..... F42B 12/60 102/497
1,325,706 A * 12/1919 Todisco ..... F42B 12/32 102/495
2,274,655 A * 3/1942 Bickel ..... F42B 10/56 102/504
2,304,060 A * 12/1942 Baylor ..... F42B 12/64 102/497
2,379,203 A * 6/1945 Vertzinsky ..... F42B 12/60 102/504
3,491,689 A * 1/1970 Marcel ..... F42B 12/62 102/340
3,903,804 A * 9/1975 Luttrell ..... F42B 12/64 102/703
4,080,900 A * 3/1978 Augenstein ..... F42B 12/64 102/495
4,430,941 A * 2/1984 Raech, Jr. ..... F42B 12/64 102/494
4,777,882 A * 10/1988 Dieval ..... F42B 12/62 102/357
5,684,267 A * 11/1997 Dean ..... F42B 12/62 102/293
7,360,489 B1 * 4/2008 Han ..... F42B 12/60 102/504
9,593,921 B1 * 3/2017 Kostka ..... F42B 8/14
2020/0208951 A1 * 7/2020 Allison ..... F42B 12/62
2020/0300591 A1 * 9/2020 Painter, III ..... F42B 12/60

* cited by examiner

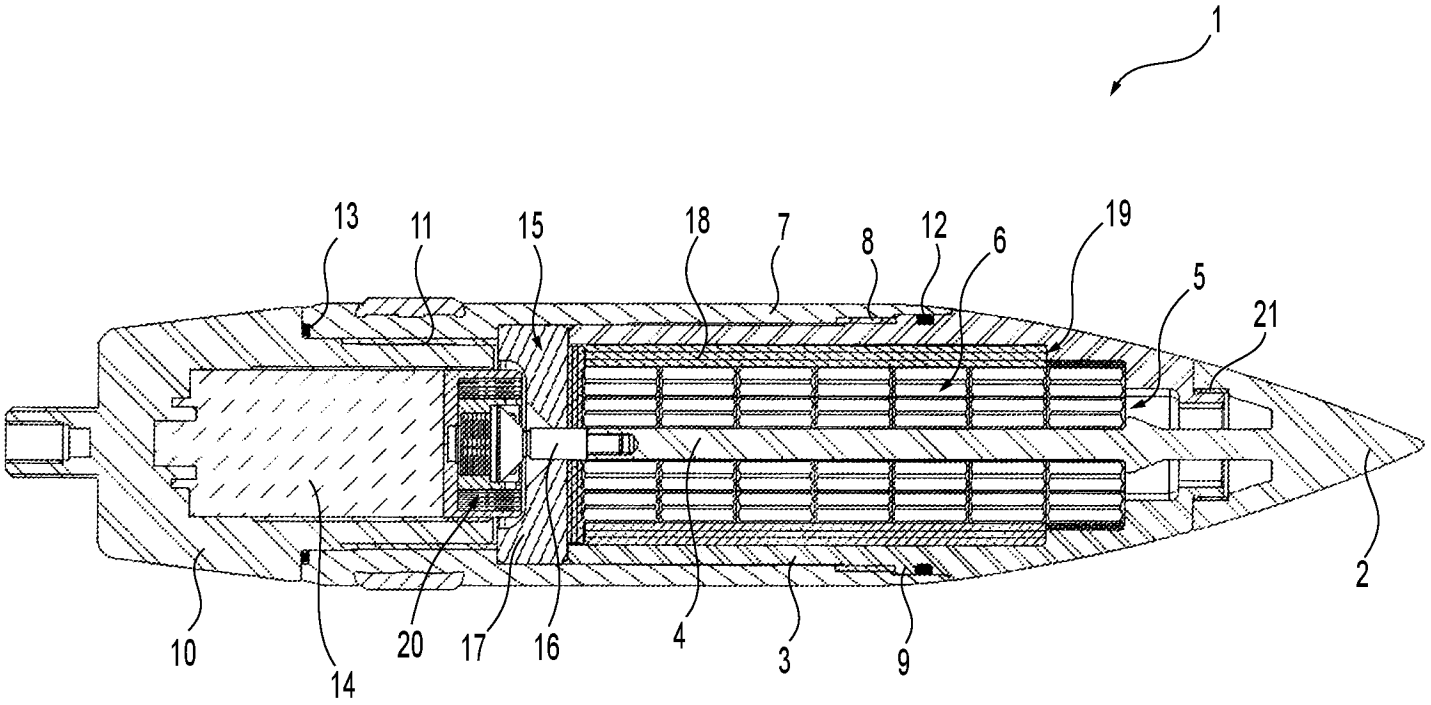
1
2
21
5
19
6
12
8
7
18
15
11
13
9
3
4
16
17
20
14
10

ANTI-AIR SHELL FOR TELESCOPED AMMUNITION WITH DOUBLE UNLOCK

SCOPE OF THE INVENTION

The technical scope of the present invention is that of anti-air shells intended to scatter sub-projectiles during their trajectory.

STATE OF THE ART

Anti-air shells that generate a spray of sub-projectiles during their trajectory are well known. Generally, these sub-projectiles are constituted by metallic balls or cylinders. Reference may be made, for example, to patent EP-2578987 which describes a medium calibre anti-air shell constituted by an ogive shaped nose cone extended by a casing and a rear end cap enclosing an air burst charge, made integral by joining means. The sub-projectiles are integrated into the casing and when the air burst charge functions the sub-projectiles are released.

The main drawback to this shell lies in the fact that the separation of the nose cone from the casing and the separation of the casing from the rear end cap are made by a single means. As a result, it is difficult to control the functioning of this shell.

DESCRIPTION OF THE INVENTION

The aim of the present invention is to supply an anti-air shell whose functioning is made in two steps so as to make the scattering of the sub-projectiles more reliable.

The invention thus relates to a medium calibre gyro-stabilized anti-air shell that includes a nose cone extended by a case tube and a central pin that delimits with the case tube a housing that encloses sub-projectiles, wherein the case tube is attached to the nose cone via an upstream thread, and the central pin and the nose cone are made of one piece; a rear end cap that encloses an air burst charge; a casing that covers the case tube, the casing being attached to a flange on the case tube via a downstream thread at a front end of the casing and the casing being attached onto the rear end cap via a thread at a rear end of the casing; and translation means positioned between the rear end cap and the case tube so as to ensure a shearing of the upstream and downstream threads.

According to one characteristic of the invention, the translation means are arranged in the casing and are activated by an ignition of the air burst charge.

According to another characteristic of the invention, the shell comprises a liner arranged in the housing and adjusted to an internal diameter of the case tube, the sub-projectiles being arranged in said liner.

Advantageously, the liner is arranged upstream and presses against a flange on the case tube and downstream against the translation means.

According to yet another characteristic of the invention, the translation means are formed by a finger meshed on a free end of the central pin of the nose cone and by a disc pressing on a free end of the case tube.

According to another characteristic of the invention, a translation of the finger drives the shearing of the upstream thread and a translation of the disc drives the shearing of the downstream thread.

According to yet another characteristic of the invention, the shell incorporates at least one sleeve arranged to press both on a rear end of the liner and against the sub-projectiles.

According to yet another characteristic of the invention, the liner is formed by a set of retainer petals for the sub-projectiles.

Advantageously, the sub-projectiles are formed by cylinders of heavy metal.

A first advantage of the invention lies in the fact that the separation of the different elements is performed step by step. Indeed, the nose cone is firstly separated from the casing, then the casing from the rear end cap.

Another advantage of the present invention lies in the fact the release device gives the casing greater strength than that of classical casings of telescoped ammunition. Indeed, the sequential double unlock device eliminates the necessity of including a mechanical embrittlement of the casing to allow the sub-munitions to be scattered.

Another advantage of the present invention lies in the specific conditioning of the sub-projectiles.

Yet another advantage of the present invention lies in the fact that the shell has a profile that is well suited to ammunition of this type.

Yet another advantage of the present invention lies in the use of the nose cone as a means to confine the sub-projectiles.

BRIEF DESCRIPTION OF THE DRAWINGS

Other characteristics, advantages and particulars of the invention will be more apparent from the additional description given hereafter with reference to a drawing, in which:

FIG. 1 represents a longitudinal section view of the shell.

DETAILED DESCRIPTION OF THE DIFFERENT EMBODIMENTS OF THE INVENTION

The invention will now be described in greater detail. As mentioned previously, the aim is to produce a spray of sub-projectiles in the direction of a target such as a missile or other by means of an anti-air shell. This shell contains a large number of sub-projectiles which must be ejected with the greatest effectiveness.

The shell according to the invention addresses this issue and thus relates to a medium-calibre gyro-stabilized anti-air shell 1 intended to produce a spray of sub-projectiles.

This shell 1 comprises a nose cone 2 extended by a case tube 3 and a central pin 4. The case tube 3 is attached to the nose cone 2 by means of an upstream thread 21. The central pin 4 and the nose cone 2 are made of one piece. The case tube 3 and the pin 4 delimit a housing 5 enclosing sub-projectiles 6. A casing 7 covers the case tube 3 over its full length in a close fit and is attached to it by means of a downstream thread 8 at its front end on a flange 9 of the case tube 3. The casing 7 is attached to a rear end cap 10 by means of a thread 11 at its rear end.

The sub-projectiles 6 may be constituted by cylinders of heavy metal.

To complete the sealing of the casing 7 with respect to the case tube 3, a seal 12 is arranged in a groove in the flange 9. It is the same case between the casing and the rear end cap where this rear end cap presses against a rear seal 13 in a chamfer made at the free end of the casing.

The rear end cap 10 encloses an air burst charge 14 connected to an igniter 20.

The shell 1 integrates translation means 15 for the sub-projectiles 6 positioned between the rear end cap 10 and the case tube 3 so as to ensure the shearing of the upstream 21 and downstream 8 threads. These translation means 15 are activated by the ignition of the air burst charge 14 as will be explained hereafter.

These translation means 15 are constituted by a finger 16, on the one hand, meshed with the free end of the central pin 4 of the nose cone 2 and on the other, by a disc 17 pressing against the free end of the case tube 3. It goes without saying that the finger 16 may be freely inserted into a drill hole made in the free end of the central pin 4.

The FIGURE shows that the sub-projectiles 6 are arranged in a liner 18 itself arranged in the housing delimited by the case tube 3, the liner being adjusted to the internal diameter of this case tube 3. This liner 18 is made of an easily split and scatterable material.

It can further be seen that the liner 18 is arranged upstream pressing against a flange 19 on the case tube 3 and downstream on the translation means 15 via at least one washer 20 arranged to press both against the rear end of the liner 18 and against the sub-projectiles 6. This liner 18 may be constituted by a set of retainer petals for the sub-projectiles 6.

Advantageously according to the invention, the finger 16 drives the shearing of the upstream thread 21 during its translation, thereby causing a first release of the nose cone 2 relative to the case tube 3 and the disc 17 causes the shearing of the downstream thread 8, thereby driving a second release of the case tube 3 relative to casing 7 and rear end cap 10.

This double release system ensures the separation of the three elements constituting the shell 1, namely the nose cone 2, the case tube 3 and the casing 7/read end cap 10 and the release of the sub-projectiles.

Functioning is as follows.

When the shell is launched further to the approach of a threat, the igniter 20 ignites the air burst charge 14 on the trajectory according to a predefined firing sequence. The thrust generated by the charge 14 firstly activates the rod 16 which shears the upstream thread 21, then activates the disc 17 which in turn shears the downstream thread 8. The three elements constituting the shell 1, the casing 7/rear end cap 10, the case tube 3 and the nose cone 2 are thus separated and distanced from one another. Then the liner 18 containing the sub-projectiles 6 is separated from the case tube 3 under the effect of the difference in mass.

Further to the disintegration of the liner 18, the sub-projectiles 6 continue on their trajectory in the form of a spray of predefined volume.

The sub-projectiles 6 scatter in space following the laws of general mechanics, that is to say the solid angle of the cone is almost entirely determined by the spin rate of the shell which creates the centrifugal acceleration. The spin rate of a telescoped ammunition shell, however, has the advantage of not dropping by more than 20% over its full trajectory.

The solid angle of the dispersion cone is, classically, between 12° and 15°.

What is claimed is:

1. A medium calibre fin-stabilised anti-air shell comprising:

a nose cone extended by a case tube and a central pin that delimits with the case tube a housing that encloses sub-projectiles, wherein the case tube is attached to the nose cone via an upstream thread, and the central pin and the nose cone are made of one piece;

a rear end cap that encloses an air burst charge;

a casing that covers the case tube, the casing being attached to a flange on the case tube via a downstream thread at a front end of the casing and the casing being attached onto the rear end cap via a thread at a rear end of the casing; and translation means positioned between the rear end cap and the case tube so as to ensure a shearing of the upstream and downstream threads.

2. The medium calibre fin-stabilised anti-air shell according to claim 1, wherein the translation means are arranged in the casing and are activated by an ignition of the air burst charge.

3. The medium calibre fin-stabilised anti-air shell according to claim 1, further comprising a liner arranged in the housing and adjusted to an internal diameter of the case tube, the sub-projectiles being arranged in the liner.

4. The medium calibre fin-stabilised anti-air shell according to claim 3, wherein the liner is arranged upstream and presses against a flange on the case tube and downstream against the translation means.

5. The medium calibre fin-stabilised anti-air shell according to claim 1, wherein the translation means are formed by a finger meshed on a free end of the central pin of the nose cone and by a disc pressing on a free end of the case tube.

6. The medium calibre fin-stabilised anti-air shell according to claim 5, wherein a translation of the finger drives the shearing of the upstream thread.

7. The medium calibre fin-stabilised anti-air shell according to claim 5, wherein a translation of the disc drives the shearing of the downstream thread.

8. The medium calibre fin-stabilised anti-air shell according to claim 3, wherein the shell incorporates at least one sleeve arranged to press both on a rear end of the liner and against the sub-projectiles.

9. The medium calibre fin-stabilised anti-air shell according to claim 3, wherein the liner is formed by a set of retainer petals for the sub-projectiles.

10. The medium calibre fin-stabilised anti-air shell according to claim 1, wherein the sub-projectiles are formed by cylinders of heavy metal.

* * * * *